US009147322B2

(12) United States Patent
Shiraishi et al.

(10) Patent No.: US 9,147,322 B2
(45) Date of Patent: Sep. 29, 2015

(54) GAMING MACHINE AND METHODS OF UPGRADING GAME SYMBOLS IN AN OUTCOME OF A GAME

(71) Applicant: Konami Gaming, Inc., Las Vegas, NV (US)

(72) Inventors: Kazutaka Shiraishi, Zama (JP); Daisuke Nakamura, Zama (JP)

(73) Assignee: KONAMI GAMING, INC., Las Vegas, NV (US)

( * ) Notice: Subject to any disclaimer, the term of this patent is extended or adjusted under 35 U.S.C. 154(b) by 0 days.

(21) Appl. No.: 14/225,304

(22) Filed: Mar. 25, 2014

(65) Prior Publication Data

US 2015/0087385 A1 Mar. 26, 2015

(51) Int. Cl.
*A63F 9/24* (2006.01)
*G07F 17/34* (2006.01)

(52) U.S. Cl.
CPC ..... *G07F 17/34* (2013.01)

(58) Field of Classification Search
CPC ..... G07F 17/32
USPC ..... 463/16, 20
See application file for complete search history.

(56) References Cited

U.S. PATENT DOCUMENTS

| | | | |
|---|---|---|---|
| 7,322,887 | B2 | 1/2008 | Belger et al. |
| 7,591,724 | B2 | 9/2009 | Baerlocher |
| 7,758,415 | B2 | 7/2010 | Kojima |
| 7,850,520 | B2 | 12/2010 | Yoshimi |
| 8,235,796 | B2 | 8/2012 | Nakamura |
| 2002/0086725 | A1 | 7/2002 | Fasbender et al. |
| 2008/0287178 | A1 | 11/2008 | Berman et al. |
| 2009/0227323 | A1 | 9/2009 | Saito |
| 2009/0227328 | A1 | 9/2009 | Saito |
| 2011/0159946 | A1 | 6/2011 | Fong et al. |

FOREIGN PATENT DOCUMENTS

| | | | |
|---|---|---|---|
| AU | 2011250713 | A1 | 5/2012 |
| JP | 11216219 | A | 8/1999 |

OTHER PUBLICATIONS

Patent Examination Report No. 1 (AU 2013231157)—Date of Issue Nov. 25, 2013.

*Primary Examiner* — Omkar Deodhar
(74) *Attorney, Agent, or Firm* — Howard & Howard Attorneys PLLC

(57) ABSTRACT

A gaming machine and method allow a player to play a game. The game has an associated set of game symbols. The game symbols in the set of game symbols are arranged in a predetermined order from lowest to highest. A display device is configured to display a plurality of symbol regions arranged in a grid. The controller is configured to randomly select an initial outcome of the game. The initial outcome of the game includes an initial game symbol associated with each of the symbol regions. The controller detects a triggering condition associated with the initial outcome of the game and responsively replaces the initial game symbol in at least one predetermined symbol region with a replacement symbol to establish a secondary outcome of the game. The replacement symbol is determined as a function of the initial symbol and the predetermined order of the game symbols.

37 Claims, 8 Drawing Sheets

GAMING MACHINE AND METHODS OF UPGRADING GAME SYMBOLS IN AN OUTCOME OF A GAME

CROSS REFERENCE TO RELATED APPLICATION

This application claims priority to Australian Patent Application No. 2013-231157, filed Sep. 23, 2013, the disclosure of which is hereby incorporated by reference in its entirety.

TECHNICAL FIELD

The subject matter disclosed herein relates generally to gaming machines and more particularly, to an apparatus and method for allowing players to play gaming machines having randomly selected symbols.

BACKGROUND OF THE INVENTION

Gaming machines, such as slot machines, are a cornerstone of the gaming industry. At least some known gaming machines include a video display device to display a reel game that includes a plurality of reels, wherein each reel includes a plurality of symbols. During game play, the gaming machine accepts a wager from a player, the player selects one or more paylines, the gaming machine spins the reels, and sequentially stops each reel to display the generated combination of symbols on the reels. The gaming machine then awards the player an award based on the combination of symbols orientated along the selected payline.

At least some known gaming machines display reels having a plurality of special symbols displayed within the reel. Known reels include a predefined number of special symbols displayed in each reel. Over time, during game play, the player may become aware of the number of special symbols that are displayed in each reel and may become frustrated because the number of special symbols within each reel remains constant for each game play. Accordingly, new features are necessary to appeal to player interest and enhance excitement in order to entice longer play and increased profitability. The present invention is directed to satisfying these needs.

SUMMARY OF THE INVENTION

In one aspect of the present invention, a gaming machine configured to allow a player to play a game is provided. The game has an associated set of game symbols. The game symbols in the set of game symbols are arranged in a predetermined order from lowest to highest. The gaming machine includes a display device and a controller. The display device is configured to display a plurality of symbol regions. The symbol regions are arranged in a grid. The display device is further configured to display one of the plurality of game symbols in each of the symbol regions. The controller is coupled to the display device and is configured to randomly select an initial outcome of the game. The initial outcome of the game includes an initial game symbol associated with each of the symbol regions. The controller is further configured to detect a triggering condition associated with the initial outcome of the game and to responsively replace the initial game symbol in at least one predetermined symbol region with a replacement symbol to establish a secondary outcome of the game. The replacement symbol is determined as a function of the initial symbol and the predetermined order of the game symbols.

In another aspect of the present invention, a method of providing a game to a player on a gaming machine having a display device is provided. The game has an associated set of game symbols. The game symbols in the set of game symbols being arranged in a predetermined order from lowest to highest. The method includes the step of displaying on the display device a plurality of symbol regions. The symbol regions are arranged in a grid. The method further includes the step of randomly selecting an initial outcome of the game. The initial outcome of the game includes an initial game symbol associated with each of the symbol regions. The method further includes the steps of detecting a triggering condition associated with the initial outcome of the game and responsively replacing the initial game symbol in at least one predetermined symbol region with a replacement symbol to establish a secondary outcome of the game. The replacement symbol being determined as a function of the initial symbol and the predetermined order of the game symbols.

In yet another aspect of the present invention, a non-transitory information recording medium on which a computer readable program is recorded is provided. The computer readable program causes a computer to function as a gaming machine that is configured to allow a player to play a game. The game having an associated set of game symbols. The game symbols in the set of game symbols are arranged in a predetermined order from lowest to highest. The program causes the computer to function as a controller coupled to a display device. The display device is configured to display a plurality of symbol regions. The symbol regions are arranged in a grid. The display device is further configured to display one of the plurality of game symbols in each of the symbol regions. The controller is configured to randomly select an initial outcome of the game. The initial outcome of the game includes an initial game symbol associated with each of the symbol regions. The controller is further configured to detect a triggering condition associated with the initial outcome of the game and to responsively replace the initial game symbol in at least one predetermined symbol region with a replacement symbol to establish a secondary outcome of the game. The replacement symbol is determined as a function of the initial symbol and the predetermined order of the game symbols.

BRIEF DESCRIPTION OF THE DRAWINGS

Other advantages of the present invention will be readily appreciated as the same becomes better understood by reference to the following detailed description when considered in connection with the accompanying drawings wherein.

Corresponding reference characters indicate corresponding parts throughout the drawings.

DETAILED DESCRIPTION OF THE PREFERRED EMBODIMENT

With reference to the drawings and in operation, the present invention overcomes at least some of the disadvantages of known gaming machines by providing a gaming machine that displays a game having a plurality of game symbol regions and upgrades the symbols located in predetermined one or more game symbol regions in response to detecting a trigger symbol.

In general, the gaming machine 10 allows a player to initiate a gaming session to play a game, such as a video slot game, via the gaming machine 10. The gaming machine 10 displays a game, accepts a wager on the game, generates a game outcome including a plurality of symbols displayed in a plurality of symbol positions, and provides an award to the player if a winning combination is displayed in the generated game outcome. The gaming machine 10 randomly generates a game outcome, spins and stops the reel to display the generated game outcome, and provides an award to the player if a winning combination appears in the game outcome.

A selected embodiment of the present invention will now be explained with reference to the drawings. It will be apparent to those skilled in the art from this disclosure that the following description of the embodiment of the present invention is provided for illustration only and not for the purpose of limiting the invention as defined by the appended claims and their equivalents.

Figure 1:
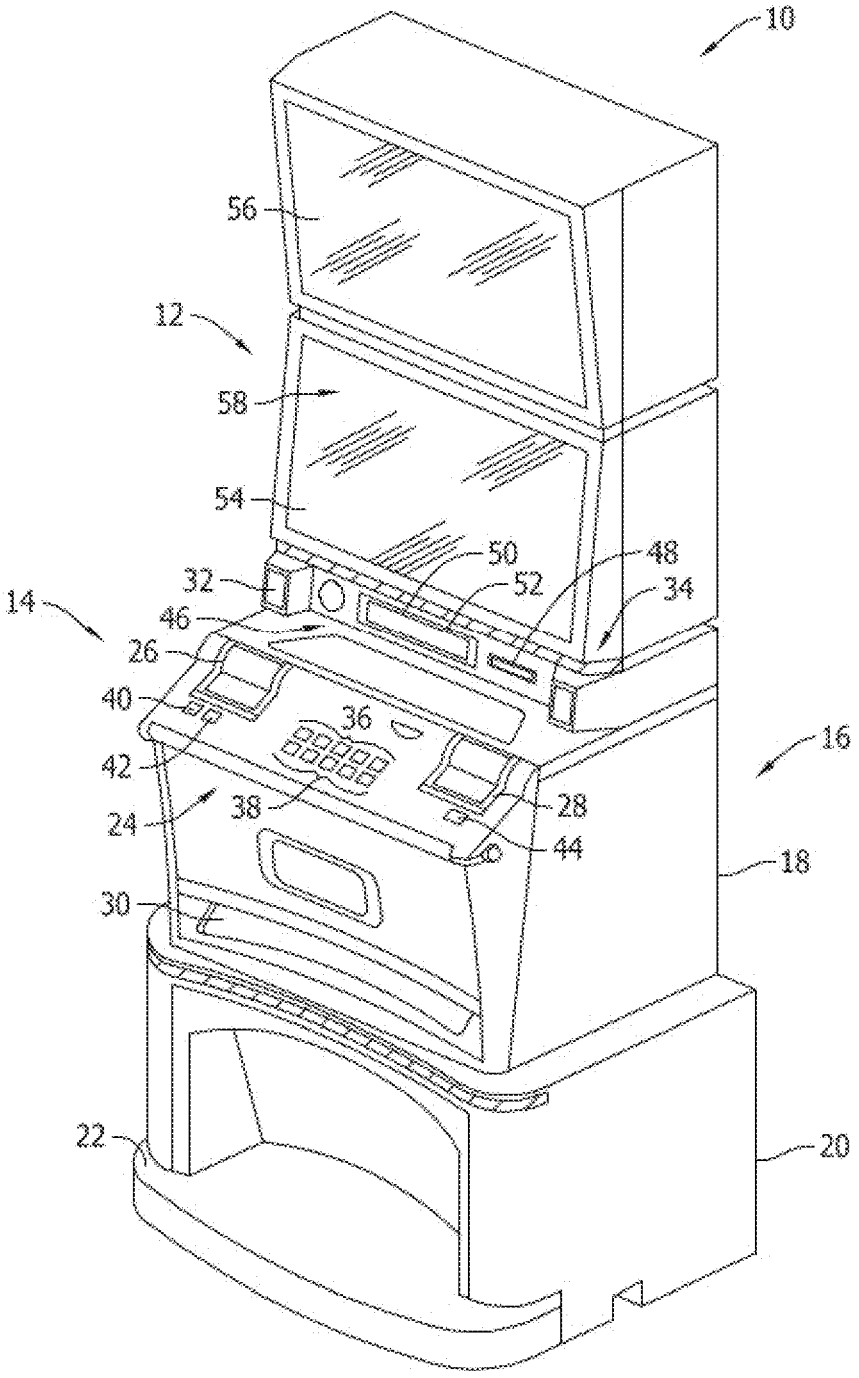
FIG. 1 is a perspective view of an exemplary gaming machine of the present invention.
Figure 2:
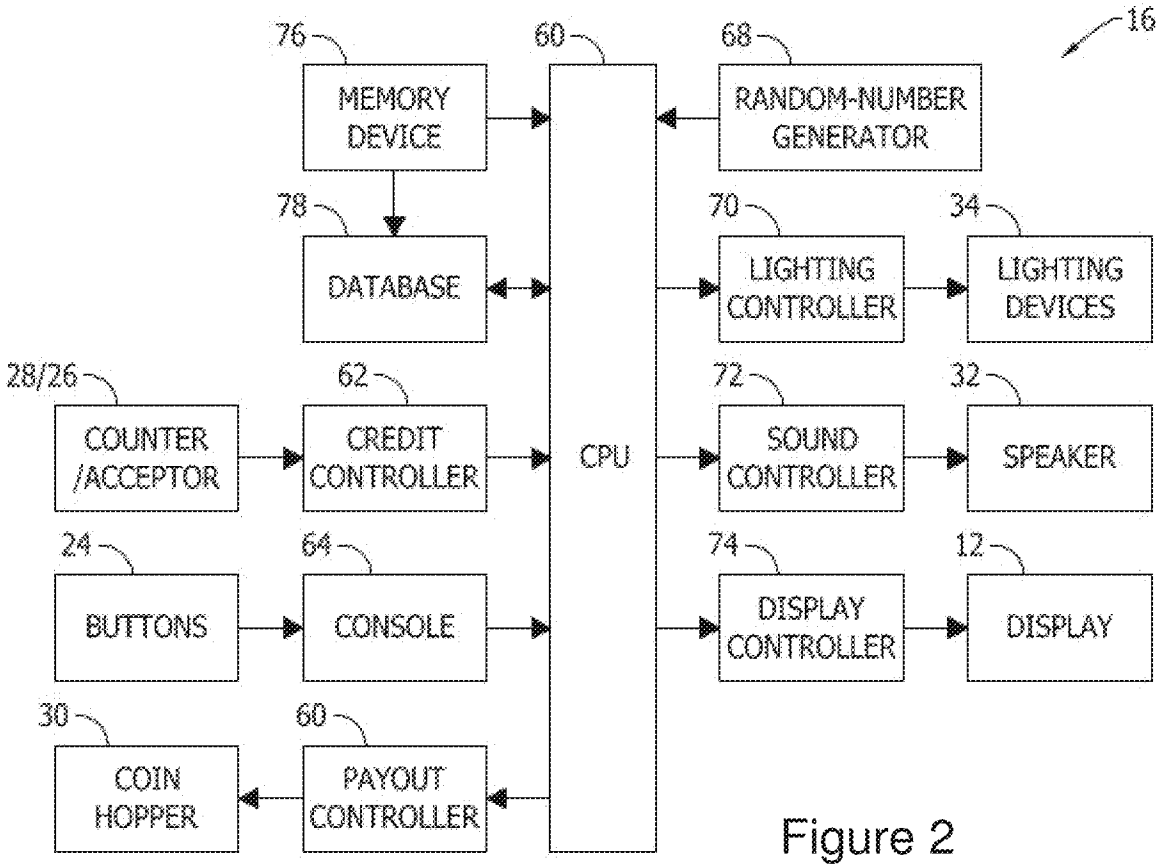
FIG. 2 is a schematic representation of the gaming machine shown in FIG. 1.

FIG. 1 is a perspective view of an exemplary gaming machine 10. FIG. 2 is a schematic representation of the gaming machine 10. In the illustrated embodiment of the present invention is a video gaming machine preferably installed in a casino. However, the gaming machine 10 may be a personal computer, laptop, cell phone, smartphone, tablet computer, personal data assistant, and/or any suitable computing device that enables a player play the game. In the illustrated embodiment, the gaming machine 10 includes a display device 12 for displaying a plurality of games, a user input device 14 to enable a player to interface with the gaming machine 10, and a gaming controller 16 that is operatively coupled to the display device 12 and the user input device 14 to enable a player to play games displayed on the display device 12. The gaming machine 10 also includes a cabinet assembly 18 that is configured to support the display device 12, the user input device 14, and/or the gaming controller 16 from a gaming stand 20 and/or a supporting surface 22.

The display device 12 and the user input device 14 are each coupled to the cabinet assembly 18 and are each accessible by the player. In one embodiment, the gaming controller 16 is positioned within the cabinet assembly 18. Alternatively, the gaming controller 16 may be separated from the cabinet assembly 18, and connected to components of the gaming machine 10 through a network such as, for example, a local area network (LAN), a wide area network (WAN), dial-in-connections, cable modems, wireless modems, and/or special high-speed Integrated Services Digital Network (ISDN) lines.

In one embodiment, the user input device 14 includes a plurality of input buttons 24, a coin slot 26, and/or a bill acceptor 28. The coin slot 26 includes an opening that is configured to receive coins and/or tokens deposited by the player into the gaming machine 10. The gaming machine 10 converts a value of the coins and/or tokens to a corresponding amount of gaming credits that are used by the player to wager on games played on the gaming machine 10.

The bill acceptor 28 includes an input and output device that is configured to accept a bill, a ticket, and/or a cash card into the bill acceptor 28 to enable an amount of gaming credits associated with a monetary value of the bills, ticket, and/or cash card to be credited to the gaming machine 10. Moreover, the gaming machine 10 may also utilize a cashless wagering system (not shown), such as a ticket in ticket out (TITO) system (not shown). In one embodiment, the bill acceptor 28 also includes a printer (not shown) that is configured to dispense a printed voucher ticket that includes information indicative of an amount of credits and/or money paid out to the player by the gaming machine 10 during a gaming session. The voucher ticket may be used at other gaming machines, or redeemed for cash, and/or other items as part of a casino cashless system (not shown).

A coin tray 30 is coupled to the cabinet assembly 18 and is configured to receive a plurality of coins that are dispensed from the gaming machine 10. One or more speakers 32 are installed inside the cabinet assembly 18 to generate voice announcements and/or sound effects associated with game play. The gaming machine 10 also includes one or more lighting devices 34 that are configured to blink and/or change brightness and color in specific patterns to produce lighting effects to enhance a visual gaming experience for the player.

In one embodiment, the input buttons 24 include a plurality of BET switches 36 for inputting a wager on a game, a plurality of selection switches 38 for selecting a betting line and/or card, a MAXBET switch 40 for inputting a maximum wager, a PAYOUT switch 42 for ending a gaming session and dispensing accumulated gaming credits to the player, and a start switch, i.e., a SPIN/DEAL button 44 to initiate an output of a game.

In the illustrated embodiment, the BET switches 36 include five switches from 1BET to 5BET to enable a player to wager between a minimum bet up to 5× minimum bet. Each selection switch 38 corresponds to a betting line such as, for example, a payline and/or symbol for a reel game, one or more cards for a card game, and/or a symbol for a roulette game, to enable a player to associate a wager with one or more betting lines. The MAXBET switch 40 enables a player to input the maximum bet that a player can spend against one time of a game. The PAYOUT switch 42 enables a player to receive the amount of money and/or credits awarded to the player during a gaming session, which has been credited onto the gaming machine 10.

The gaming machine 10 also includes a player tracking device 46 that is coupled to the gaming controller 16 for identifying the player and/or a player tracking account that is associated with the player. The player tracking account may include, but is not limited to, gaming credits available to the player for use in playing the gaming machine 10. The player tracking device 46 is configured to communicate player account information between a player tracking controller (not shown) and the gaming machine 10. For example, the player tracking device 46 may be used to track bonus points and/or credits awarded to the player during a gaming session and/or track bonus and/or credits downloaded to the gaming machine 10 from the player tracking system. In the illustrated embodiment, the player tracking controller assigns a player status, e.g. a player ranking, based on the player account information. For example, the player tacking information may include, but is not limited to, a frequency in which the player plays a game, the average wager the player makes per play of a game, a total amount wagered by the player over a predefined period of time, and/or any other suitable player tracking information. In addition, the player tracking controller may assign a player a higher player ranking based on a high average wager and/or a high total wager amount as compared with other tracked players. The gaming machine 10 may receive the player tracking information from the player tracking controller and determine the symbol selection factor based at least in part on the received player tracking information associated with the current player.

The player tracking device 46 is coupled to the gaming cabinet assembly 18 and includes a player identification card reader 48, a data display 50, and a keypad 52. The player identification card reader 48 is configured to accept a player tracking card (not shown) inserted by the player, and read information contained on the player tracking card to identify the player account information. The player identification card reader 48 may include, but is not limited to, a barcode reader, a magnetic card reader, and/or a radio frequency identification (RFID) card reader. The keypad 52 is configured to accept a user selection input such as, for example, a unique player personal identification number (PIN) to facilitate enabling the gaming machine 10 to identify the player, and access player account information associated with the identified player to be displayed on the data display 50. In one embodiment, the data display 50 includes a touchscreen panel that includes the keypad 52. Alternatively, the data display 50 and the keypad 52 may be included in the display device 12.

In one embodiment, the display device 12 includes a first display 54 and a second display 56. The first display 54 is configured to display a game screen 58 (shown in FIG. 3) including indicia and/or symbols for use in a game, e.g., cards used by a card game, roulette wheel and symbols used in a roulette game, and reels used in a reel game. The game screen 58 may include any type of game including, but not limited to, a video slot game, a keno game, a blackjack game, a video poker game, or any type of game which allows a player to make a wager, play a game, and potentially provide the player an award based on an outcome of the game and a paytable. The second display 56 is configured to display game play instructions for performing the game including, but not limited to, playing instructions, paytables, paylines, betting lines and/or any other information to enable the gaming machine 10 to function as described herein. Moreover, each display 54 and 56 may be configured to display at least a portion of the game screen 58 and/or game play instructions. In one embodiment, the first and second displays 54 and 56 each include a flat panel display, such as a cathode ray tube display (CRT), a liquid crystal display (LCD), a light-emitting diode display (LED), an organic light-emitting diode display (OLED), an active-matrix organic light-emitting diode display (AMOLED), a plasma display, and/or any suitable visual output device capable of displaying graphical data and/or text to a user. Alternatively, a single component, such as a touch screen, may function as both the display device 12 and as the user input device 14. In an alternative embodiment, the first display 54 and/or the second display 56 includes a plurality of mechanical reels displaying a plurality of game symbols.

Referring to FIG. 2, in one embodiment, the gaming controller 16 includes a processor, i.e., a central processing unit (CPU) 60, a credit controller 62, a console unit 64, a payout controller 66, a random-number generator (RNG) 68, a lighting controller 70, a sound controller 72, a display controller 74, a memory device 76, and a database 78. Memory device 76 includes a computer readable medium, such as, without limitation, random access memory (RAM), read-only memory (ROM), erasable programmable read-only memory (EPROM), flash memory, a hard disk drive, a solid state drive, a diskette, a flash drive, a compact disc, a digital video disc, and/or any suitable device that enables the CPU 60 to store, retrieve, and/or execute instructions and/or data.

The CPU 60 executes various programs, and thereby controls other components of the gaming controller 16 according to player instructions and data accepted by the user input device 14. The CPU 60 in particular executes a game program, and thereby conducts a game in accordance with the embodiments described herein. The memory device 76 stores programs and databases used by the CPU 60. Moreover, the memory device 76 stores and retrieves information in the database 78 including, but not limited to, wagers, wager amounts, average wagers per game, a game type, a number of reels associated with a game, a number of reel strips associated with each reel, a number of symbol positions being displayed on each reel strip, a type of symbols being displayed with each symbol position, a predefined set of normal symbols, a predefined set of special symbols, image data for producing game images and/or screens on the display device 12, and temporarily stores variables, parameters, and the like that are used by the CPU 60. In addition, the memory device 76 stores indicia, symbol weights, symbol values, selection probabilities tables which represent relationships between symbol selection probabilities and symbol selection factors, paytables, and/or winning combination tables which represent relationships between combinations of random numbers and types of awards. In one embodiment, the memory device 76 utilizes RAM to temporarily store programs and data necessary for the progress of the game, and EPROM to store, in advance, programs and data for controlling basic operation of the gaming machine 10, such as the booting operation thereof.

The credit controller 62 manages the amount of player's credits, which is equivalent to the amount of coins and bills counted and validated by the bill acceptor 28. The console unit 64 is coupled to the user input device 14 to monitor player selections received through the input buttons 24, and accept various instructions and data that a player enters through the input buttons 24. The payout controller 66 converts a player's credits to coins, bills, or other monetary data by using the coin tray 30 and/or for use in dispensing a credit voucher via the bill acceptor 28.

The lighting controller 70 controls one or more lighting devices 34 to blink and/or change brightness and color in specific patterns in order to produce lighting effects associated with game play. The sound controller 72 controls the speakers 32 to output voice announcements and sound effects during game play. The display controller 74 controls the display device 12 to display various images on screens preferably by using computer graphics and image data stored in the memory device 76. More specifically, the display controller 74 controls video reels in a game screen displayed on the first display 54 and/or the second display 56 by using computer graphics and the image data.

The RNG 68 generates and outputs random numbers to the CPU 60 preferably at the start of each round of a game. The CPU 60 uses the random numbers to determine an outcome of the games. For example, if the game is a video slot game, the CPU 60 uses the RNG 68 to randomly select an arrangement of symbols to be displayed on video reels. Moreover, the CPU 60 generally uses random numbers generated by the RNG 68 to play the games and to determine whether or not to provide an award to a player. In addition, the CPU 60 generates game outcomes including combinations of random numbers, and compares the generated combinations with winning combinations stored in the winning combination table to determine if the generated outcome is a winning outcome that is associated with a type of award.

Figure 3A:
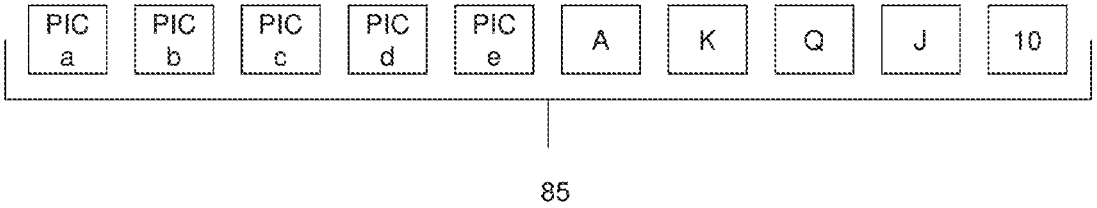
FIG. 3A is a diagrammatic representation of a set of game symbols being arranged in a predetermined order from lowest to highest, according to an embodiment of the present invention.

With reference to FIG. 3A, in one embodiment of the present invention game utilizes a set of game symbols 85. In the illustrated embodiment, the set of games symbols 85 include: 10, J, Q, K, A, PIC e, PIC d, PIC c, PIC b, and PIC a. The set of game symbols are arranged in a predetermined order from lowest to highest. In the illustrated embodiment of FIG. 3, the set of game symbols 85 are arranged from right to left with "10" being the lowest symbol and "PIC a" being the highest symbols.

Figure 3B:
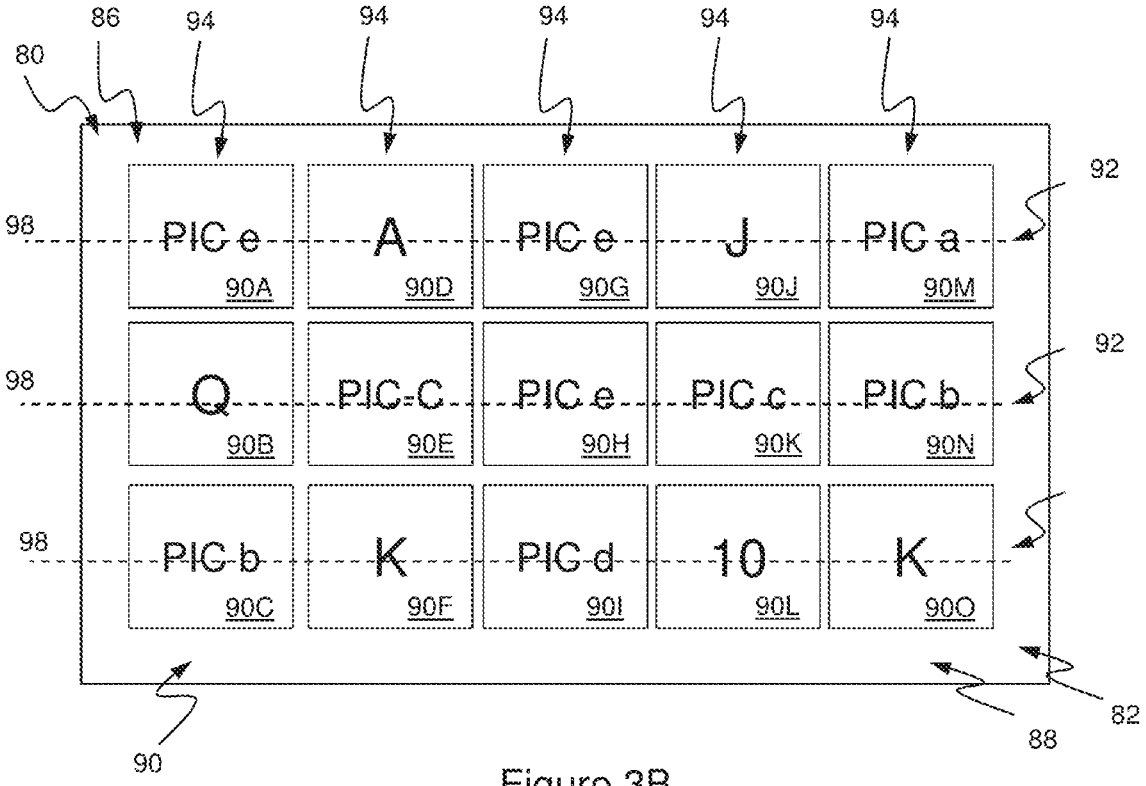
FIG. 3B is a first diagrammatical representation of a display of a video slot game, according to a first embodiment of the present invention.

FIG. 3B is an exemplary graphical display of a game 80 that is displayed by the gaming machine 10. In the illustrated embodiment, the gaming controller 16 is configured to display the game 80 on the display device 12. In one embodiment, the game 80 is a video slot game. However, it should be noted that the game 80 may be any type of game upon which a player could make a wager including, but not limited to a keno game, a blackjack game, a video poker game, or any type of game that enables the gaming controller 16 to function as described herein. In the illustrated embodiment, the game 80 is displayed on the first display 54. Alternatively, the game 80 may be displayed on the first display 54 and/or the second display 56.

In general, during play of the game 80, the gaming controller 16 randomly generates an initial outcome 82 of the game 80 and displays the generated game outcome 82 in a display area 84. The gaming controller 16 randomly selects a plurality of game symbols 86 from the predefined set of possible game symbols 85. In one embodiment, the gaming controller 16 displays the selected game symbols 86 associated with the initial game outcome 82 in the game display area 84. In another embodiment, the initial game outcome 82 may not be displayed in the game display area 84.

In the illustrated embodiment, the plurality of symbols 86 are displayed in a grid 88 having a plurality of symbol regions or cells 90 arranged along a plurality of rows 92 and a plurality of columns 94. Each cell 90 displays a corresponding game symbol 86 associated with the initial game outcome 82.

In one embodiment, the gaming controller 16 displays the game symbols 86 within a plurality of reels. In one embodiment, each cell 90 may correspond to an individual reel. In another embodiment, each column may correspond to an individual reel, i.e., the cells 90 of the column correspond to adjacent locations on the reel. In another embodiment, as discussed below, the grid 88 may include one or more individual reels corresponding to individual cells 90 and one or more column reels where all of the cells 90 in a column correspond to the same reel.

The game 80, in the illustrated embodiment of FIGS. 3B and 3V, includes a 3×5 grid of individual reels, i.e., each cell 90 in the grid 88 corresponds to an individual reel.

The game 80 may also include a plurality of paylines 98 that extend across one or more cells 90 to indicate, to the player, a combination of game symbols 86. In the illustrated embodiment three horizontal paylines 98 are shown. However, as will be recognized by one skilled in the art, any number and shape of paylines may be utilize.

Each slot game is generally played in a conventional manner. The player makes a wager, which may be based on a predetermined denomination and a selected number of paylines, the gaming controller 16 randomly generates an outcome for the game, spins the reels, and selectively stops the reels to display a game symbol 86 in each of the display cells 90. If a predetermined pattern of symbols 86 is randomly chosen for each cell 90 on a played payline 98, the player may be awarded a payout based on the payline, the wager, and a predetermined paytable. Moreover, the player may be awarded a payout if the combination of symbols associated with a selected payline is a winning combination. In addition, a player may receive a bonus feature and/or a bonus game based on the combination of symbols associated with the selected payline and/or the appearance of one or more predefined symbols in the game outcome 82. Many variations to the above described general play of a slot game fall within the scope of the present invention. Such slot games are well-known in the art, and are therefore not further discussed.

In the illustrated embodiment, the gaming controller 16 receives a signal, from the user input device 14, that is indicative of a player's selection to initiate a gaming session including a wager amount, and a selection of one or more paylines 98 associated with a predefined set of cells 90 within the displayed grid 88. In the illustrated embodiment, the game 80 is a multi-line game, i.e., the paylines include horizontal paylines and/or diagonal pay-lines, and/or zig-zag paylines. Moreover, the user input device 14 may allow the player to toggle to increase the bet per payline a credit at a time (up to the maximum bet). The gaming controller 16 randomly generates an outcome 82 of the game 80, and displays the generated outcome 82 on the display device 12. In one embodiment, the gaming controller 16 is configured to rotate, and/or spin each reel to initiate a game play, and stop each reel to display a plurality of symbols 86 associated with the randomly generated outcome 82. In addition, the gaming controller 16 is adapted to determine if the generated outcome 82 is a winning outcome based on the displayed game symbols 86, a pay-table, a wager, and one or more player selected paylines 98. More specifically, the gaming controller 16 determines if a combination of symbols 86 arranged along the selected payline 98 is a winning combination. The gaming controller 16 may provide an award in response to the outcome 82 of the game 80. In general, the term "award" may be a payout, in terms of credits or money. Thus, the gaming controller 16 may award a regular payout in response to the outcome 82 of the game 80. However, it should be noted that the term award may also refer to other types of awards, including, prizes, e.g., meals, show tickets, etc. . . . , as well as in-game award, such as free games or awarding the player one or more wild symbols or stacked wild symbols in each of the games.

Returning to FIG. 3A, in the first illustrated embodiment, as discussed above, the display device 12 is configured to display a plurality of symbol regions 90. In the illustrated embodiment, the grid 88 includes 15 symbol regions 90A, 90B, 90C, 90D, 90E, 90F, 90G, 90H, 90I, 90J, 90K, 90L, 90M, 90N, 90O. The controller 16 is coupled to the display device 12 and is configured to randomly select an initial outcome 82 of the game 80. As shown, the initial outcome 82 of the game 80 includes an initial game symbol 86 associated with each of the symbol regions 90.

In one embodiment, the initial game outcome 82 is displayed in the grid 88. In another embodiment the initial game outcome 82 is not displayed.

The controller 16 is further configured to detect a triggering condition associated with the initial outcome 82 of the game 80. The initial game condition may be a predetermined winning condition, a predetermined outcome or arrangement of symbols within the grid 82, an appearance of one or more or a predetermined number of scatter symbols (see below), or any other triggering condition.

If the triggering condition is detected by the controller 16, the controller 16 replaces the initial game symbol 86 in the initial outcome 82 in at least one predetermined symbol region 90 with a replacement symbol to establish a secondary outcome of the game 83. The at least one predetermined symbol region 90 may be one or more of the symbol regions 90. The at least one predetermined symbol region 90 may be constant for all instances of the game 80 or may vary based on a predetermined factor or may be randomly determined before each play of the game 80.

Figure 3C:
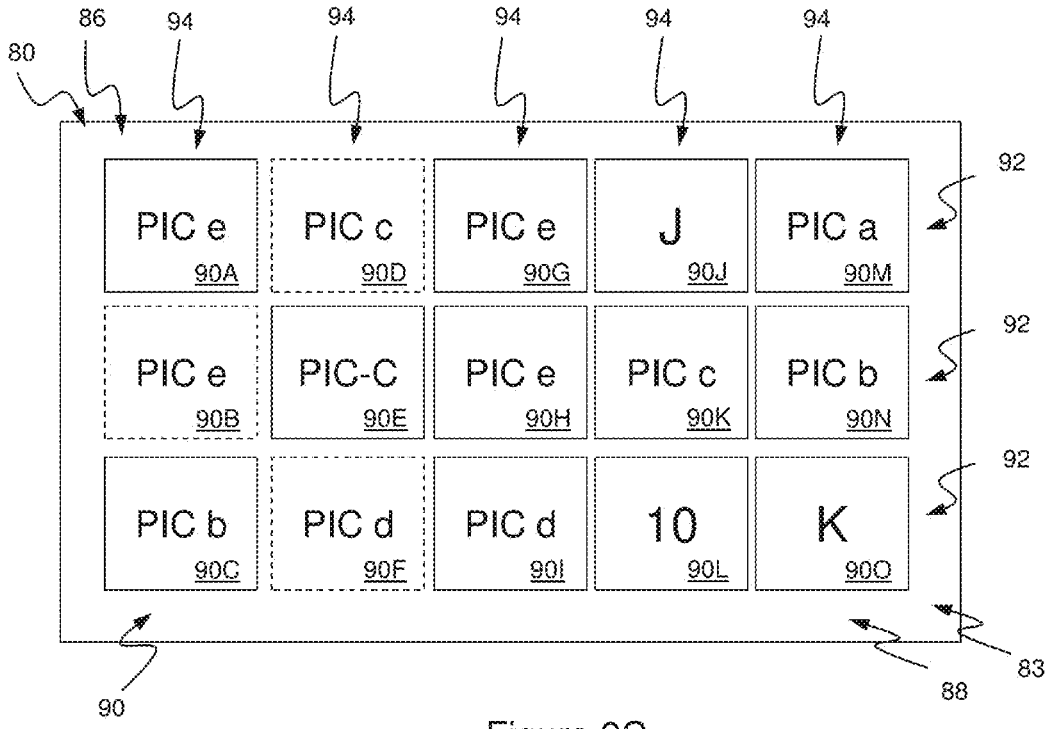
FIG. 3C is a second diagrammatical display of a video slot game, according to the embodiment of FIG. 3B.

With particular reference to FIG. 3C, in the illustrated embodiment the at least one predetermined symbol region 90 includes three symbol regions 90B, 90D, 90F which are also shown with dashed lines.

The replacement symbol(s) 90 are determined as a function of the initial symbol 90 and the predetermined order 85 of the game symbols 86.

For instance, each replacement symbol 86 could be determined as an offset from the initial symbol 86. The offset could be negative or positive. In other words, the replacement symbol could be lower than the initial symbol or higher than the initial symbol. The offset could be constant or vary per game instance. The offset may be the same or different for every predetermined symbol region 90.

In the illustrated embodiment of FIGS. 3B-3C, the offset is a +3. Thus, every initial symbol 86 in a predetermined symbol region 90 is replaced with a replacement symbol 90 which is 3 symbols higher in the predetermined ranking 85. Thus, the Q symbol in symbol region 90B is replaced with a PIC e symbol; the A symbol in symbol region 90D is replaced with a PIC c symbol; and the K symbol in symbol region 90F is replaced with a PIC d symbol.

As discussed above, the gaming machine 10 allows the player to make a wager. The controller 16 may be further configured to award the player an initial award as a function of the wager, the initial outcome and an initial paytable. The controller 16 may be further configured to award a secondary award as a function of the secondary outcome and a secondary paytable. The secondary paytable may be the same or different than the initial paytable. In an alternative embodiment, the controller 16 only awards an award based on the secondary outcome, the wager and a paytable.

In one embodiment, the display device 12 is configured to display the initial outcome 82 and the secondary outcome 83 in the grid 88. In another embodiment, only the secondary outcome 83 is displayed.

Figure 3D:
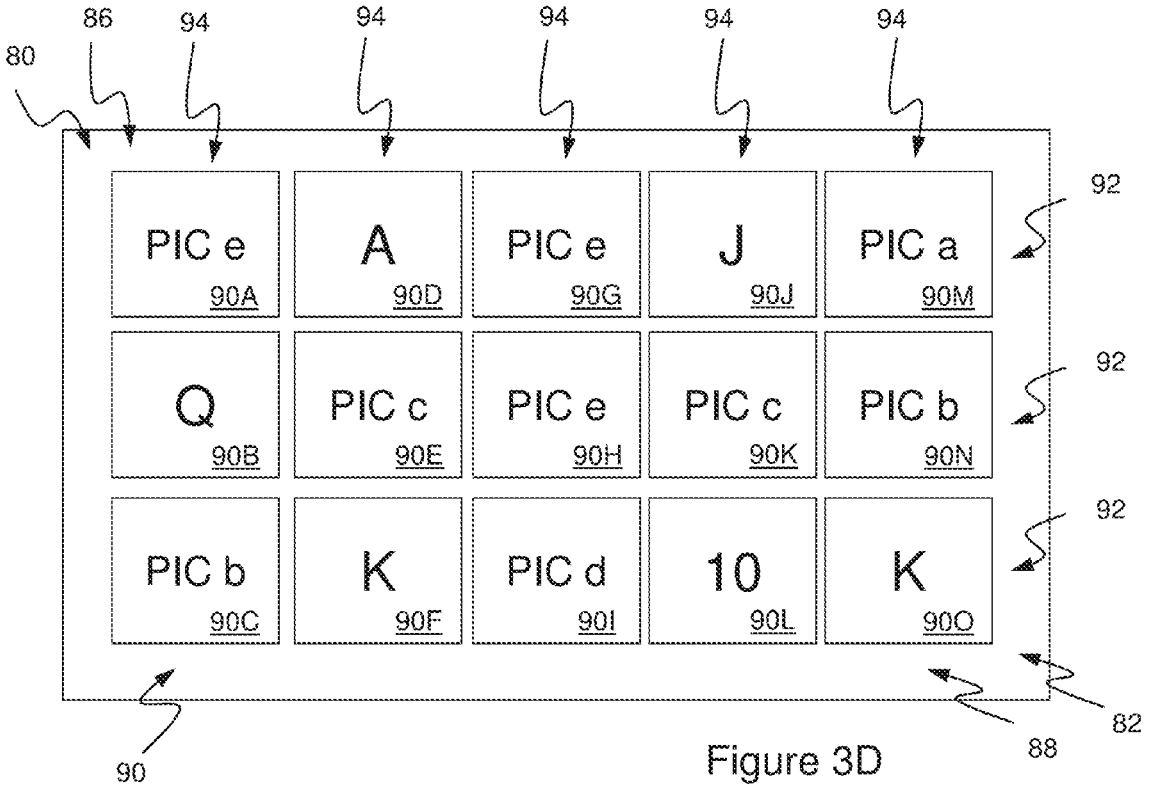
FIG. 3D is a first diagrammatical representation of a display of a video slot game, according to a second embodiment of the present invention.
Figure 3E:
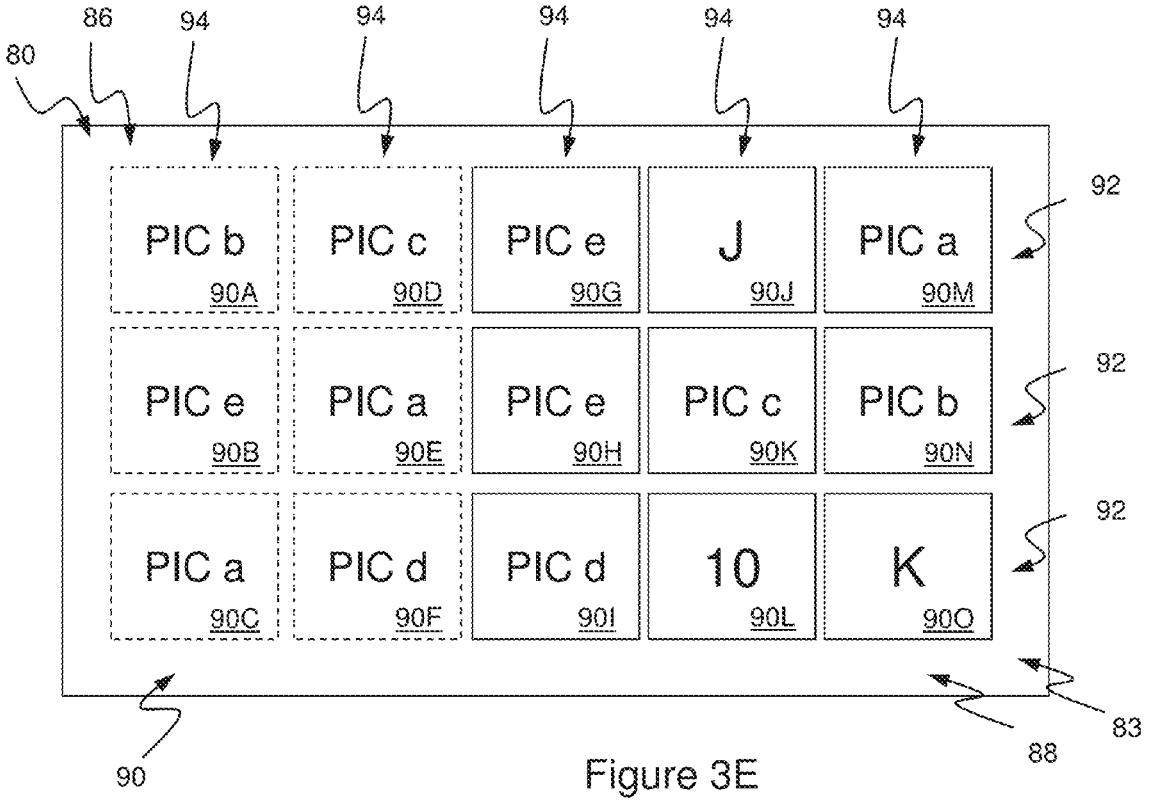
FIG. 3E is a first diagrammatical representation of a display of a video slot game, according to a second embodiment of the present invention.

In a second exemplary embodiment, the grid 88 has a plurality of columns 94. Each column 94 includes at least two symbol regions 90. With reference to FIGS. 3D and 3E (in which similar elements are labeled with similar reference numbers), in one illustrated embodiment, the grid 88 is a 3×5 grid, with 5 columns 94. Each column 94 includes 3 symbol regions. At least one of the columns 94 forms a single reel. Each of the other symbol regions 90 is an individual reel.

For example, in the illustrated embodiment of FIGS. 3D and 3E, each of the first two columns 94 form a single reel. In other words, symbol regions 90A, 90B, 90C represent adjacent symbol positions on a single reel and symbol regions 90D, 90E, 90F form another single region. Thus, the symbols 86 within the outcomes 82, 83 in symbol regions 90A, 90B, 90C correspond to adjacent locations on a virtual reel strip associated with a first reel. Likewise, the symbols 86 within the outcomes 82, 83 in symbol regions 90D, 90E, 90F correspond to adjacent locations on a virtual reel strip associated with a second reel. Each of the symbol regions 90G-90O represent individual reels. This, the symbols 86 in symbol regions 90G-90O within the outcomes 82, 83 are independent from each other.

The symbol regions 90 within the single reel formed by the symbol regions 90 in at least one column are the predetermined symbol regions 90. Thus, if the controller 16 detects the triggering condition, all of the symbols 86 in the symbol regions or cells 90 in the at least column are replaced with replacement symbols 86.

FIG. 3D illustrates an initial outcome 92, each of the first and second columns 94 form a single reel. All of the other symbol regions 90G-90O are formed as individual reels. As discussed above, in one embodiment the initial outcome 82 is displayed and may be evaluated to determine if there is a winning combination, e.g., a predetermined combination of symbols on a played payline. If the triggering condition is detected in the initial outcome 82, then the symbols 86 located in regions 90A-90F (shown in dashed lines) are replaced with replacement symbols 86 to form a secondary outcome 83 as shown in FIG. 3E.

The replacement symbol(s) 90 are determined as a function of the initial symbol 90 and the predetermined order 85 of the game symbols 86.

For instance, each replacement symbol 86 could be determined as an offset from the initial symbol 86. The offset could be negative or positive. In other words, the replacement symbol could be lower than the initial symbol or higher than the initial symbol. The offset could be constant or vary per game instance. The offset may be the same or different for every predetermined symbol region 90.

In the illustrated embodiment of FIGS. 3D-3E, the offset is a +3. Thus, every initial symbol 86 in the predetermined symbol regions 90A-90F is replaced with a replacement symbol 90 which is 3 symbols higher in the predetermined ranking 85. If the highest symbol 90 is reached prior to reaching the offset than in one embodiment, the highest symbol (PIC a) is used. In another embodiment, the offset is continued starting at the lowest symbol.

Thus, the PIC e symbol in symbol region 90A is replaced with a PIC b symbol; the Q symbol in symbol region 90B is replaced with a PIC e symbol; the PIC b symbol in symbol region 90C is replaced with a PIC a symbol; the A symbol in region 90D is replaced with a PIC c symbol; the PIC c symbol in region 90E is replaced with a PIC a symbol; and the K symbol in region 90F is replaced with a PIC d symbol.

The replaced symbols 86 in symbol regions 90A-90F plus the initial symbols 86 in regions 90G-90O form the secondary outcome 83. In one embodiment, the controller 16 evaluates the secondary outcome 83 and may award the player an award based on the secondary outcome 83, the player's wager and a paytable.

Figure 10:
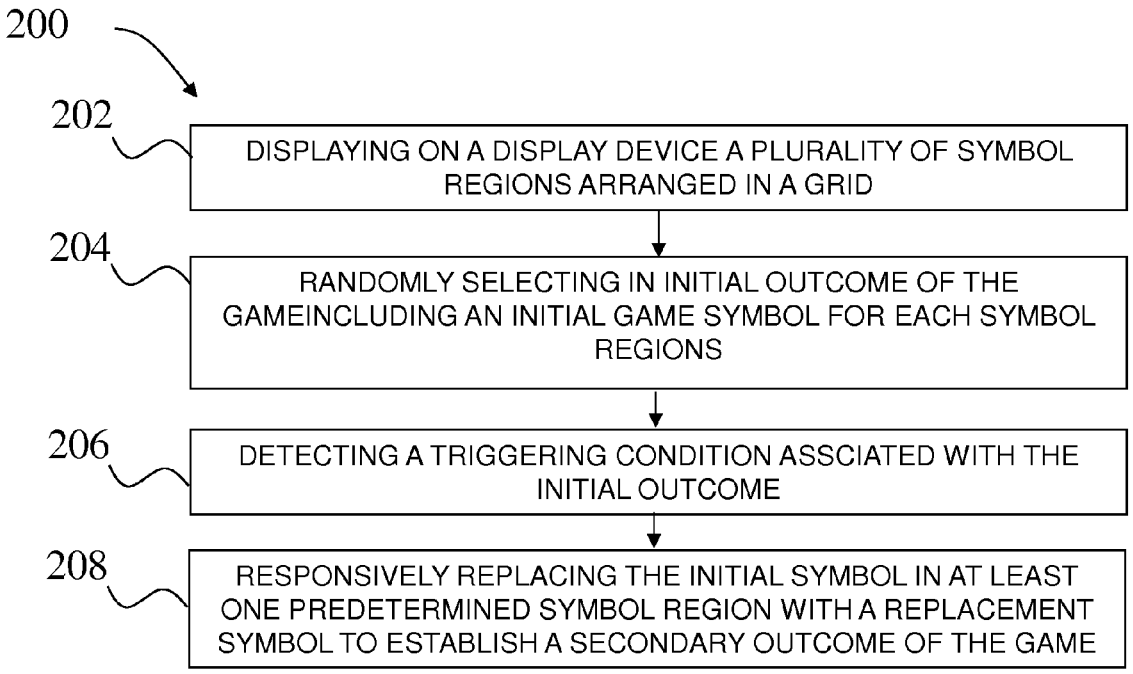
FIG. 10 is a flow diagram of a method for providing a game to a player according to an embodiment of the present invention.

With reference to FIG. 10 in another aspect of the present invention, a method 200 of providing a game to a player on a gaming machine 10 having a display device 12 is shown. The game has an associated set of game symbols 85. The game symbols 85 in the set of game symbols are arranged in a predetermined order from lowest to highest. In a first step 202, a plurality of symbol regions 90 are displayed on the display device 12. The plurality of symbol regions are arranged in a grid 88. In a second step 204, an initial outcome of the game is randomly selected. The initial outcome of the game includes an initial game symbol 86 associated with each of the symbol regions 90. In a third step 206, a triggering condition associated with the initial outcome of the game is detected. If the triggering condition is detected, in a fourth step 206 the initial game symbol in at least one predetermined symbol region is replaced with a replacement symbol to establish a secondary outcome of the game. The replacement symbol is determined as a function of the initial symbol and the predetermined order of the game symbols.

INDUSTRIAL APPLICABILITY

With reference to FIGS. 4-9 (in which similar elements are labeled with similar reference numbers), some of the concepts of the present invention are embodied in a game having a theme and title of "Exotic Princess".

Figure 4:
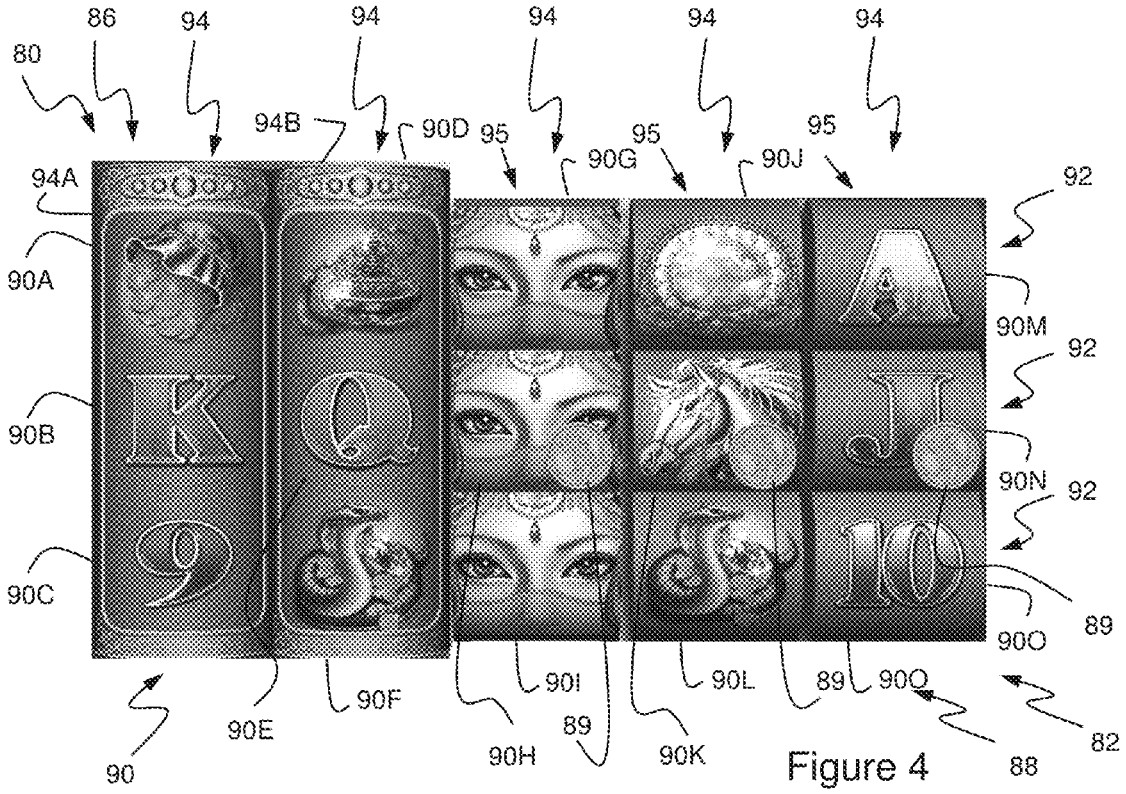
FIG. 4 is a graphical representation of a portion of the gaming machine shown in FIG. 1 including an exemplary video slot game illustrating a plurality of slot reels, according to an embodiment of the present invention.

With particular reference to FIG. 4, the game 80 includes a 3×5 grid 88 formed by symbol regions 90A-90O arranged in rows 92 and columns 94. The grid 88 has a plurality of associated reels. Each reel has an associated virtual reel strip (not shown) having a predetermined arrangement of game symbols. The outcomes of the game 80 includes one symbol 86 on the associated virtual reel strip being located in, and displayed in, a corresponding symbol region 90.

Figure 5:
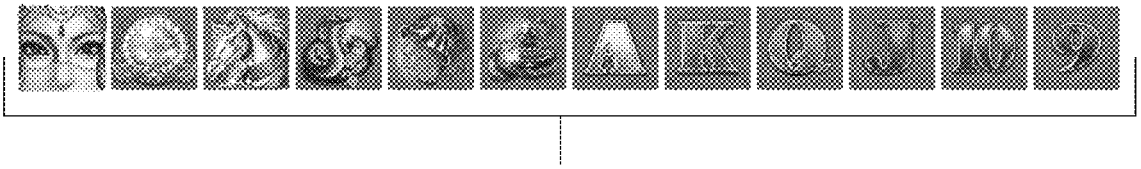
FIG. 5 is a graphical representation of a set of game symbols used in the video slot game of FIG. 4.

With particular reference to FIG. 5, the Exotic Princess game 80 uses ten symbols 86 arranged from left to right from lowest to highest. In the illustrated embodiment, the symbols 86 used in the Exotic Princess from lowest to highest are: 9, 10, J, Q, K, A, Lamp, Coins, Cobra, Horse, Jewel, Princess.

Returning to FIG. 4, in the Exotic Princess game 80, each of the first and second columns 94 form a single reel (as indicated or marked by first frame 94A and second frame 94B). In other words, a first virtual reel strip (not shown) is associated with the first column 94. When the virtual reel strip is in a stopped condition, adjacent symbols on the reel strip appear in regions 90A-90C. Likewise, a second virtual reel strip (not shown) is associated with the second column 94. When the second virtual reel strip is in a stopped location, adjacent symbols on the second reel strip appear in regions 90D-90F.

The first and second virtual reel strips may include a predetermined set of adjacent symbols which include the same symbol, i.e., a symbol stack. The symbol stack may be visualized by a plurality of the same symbol 86, one in each region 90 of the symbol stack. Alternatively, a large symbol or graphic (see FIGS. 6 and 7) may be used to represent the stack. The symbol in the symbol stack may be static or may be dynamic.

In the Exotic Princess game 80, each of the other symbol regions 90G-90O have an associated, separate virtual reel strip, such that the symbol 86 appearing in each symbol regions 90G-90O is independent from each other.

The Exotic Princess game 80 has a main game and a bonus game. In the illustrated embodiment bonus game includes a number of free spins. The bonus game is initiated when a bonus triggering condition occurs in the main game.

In one embodiment, the triggering condition is the appearance of a predetermined symbol. In the Exotic Princess game, the predetermined symbol is a scatter symbol.

In an alternative embodiment, the triggering condition is the appearance of the predetermined symbol in the initial outcome of the game. The predetermined symbol is one of the game symbols, i.e., one of the symbols in the set of game symbols.

In one aspect of the present invention, each replacement symbol is determined as a function of an offset from the associated initial symbol in the predetermined order. In one embodiment, the offset is equal to the number of predetermined symbols. For example, if the 1 predetermined symbol appears, then the offset is +1. If 2 predetermined symbols appear, then the offset is +2.

With reference to FIG. 4, in one embodiment, one or more of the columns 94 includes a virtual triggering reel. The virtual triggering reel overlays all of the cells 90 in the respective column 94. In the illustrated embodiment of FIG. 4, each of the third, fourth, and fifth columns 94 includes a virtual triggering reel 95. Each virtual triggering reel has a single scatter symbol 89 (see FIG. 9). The virtual triggering reels 95 are spun during the main game.

In one embodiment, if three scatter symbols 89 appear in the initial outcome of the main game 82, then a number of free spins are awarded. In one embodiment, the three scatter symbols 90 must appear on the middle row (as shown in FIG. 4).

In another aspect of the invention, the scatter symbols 89 may also be used to trigger the symbol upgrade feature. For example, the upgrade feature may be triggered by any number of scatter symbols 89 appearing in the initial outcome 82. In one embodiment, the scatter symbols 89 may be located in any one of the cells 90G-90O to trigger the upgrade feature. In another aspect of the present invention, the number of scatter symbols 89 appearing in the initial outcome 82 is used to determine the number of symbol upgrades. For example, if one scatter symbol 90 appears in the initial outcome 82, then the initial symbols 89 in the at least one predetermined symbol regions 90 are upgraded by +1, i.e., replaced by a replacement symbol 89. If two scatter symbols 90 appear in the initial outcome 82, then the symbols in the at least one predetermined symbol regions 90 are upgrade by +2. If three scatter symbols 90 appear in the initial outcome 82, then the symbols in the at least on predetermined symbol regions 90 are upgrade by +3. In the illustrated embodiments, the initial symbols 88 in cells 90A-90F are upgraded, i.e., replaced by a replacement symbol.

In aspect of the present invention, during the bonus game, e.g., the free spins, additional free spins may be award. Also, the upgrade feature may be awarded during the free spins. Alternatively, the upgrade feature may be award only during the free spins.

Figure 8:
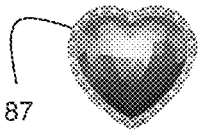
FIG. 8 is a graphical representation of a scatter symbol used in the exemplary video slot game, according to an embodiment of the present invention.
Figure 9:
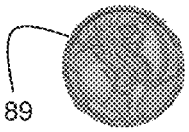
FIG. 9 is a graphical representation of a second scatter symbol used in the exemplary video slot game, according to an embodiment of the present invention.
Figure 6:
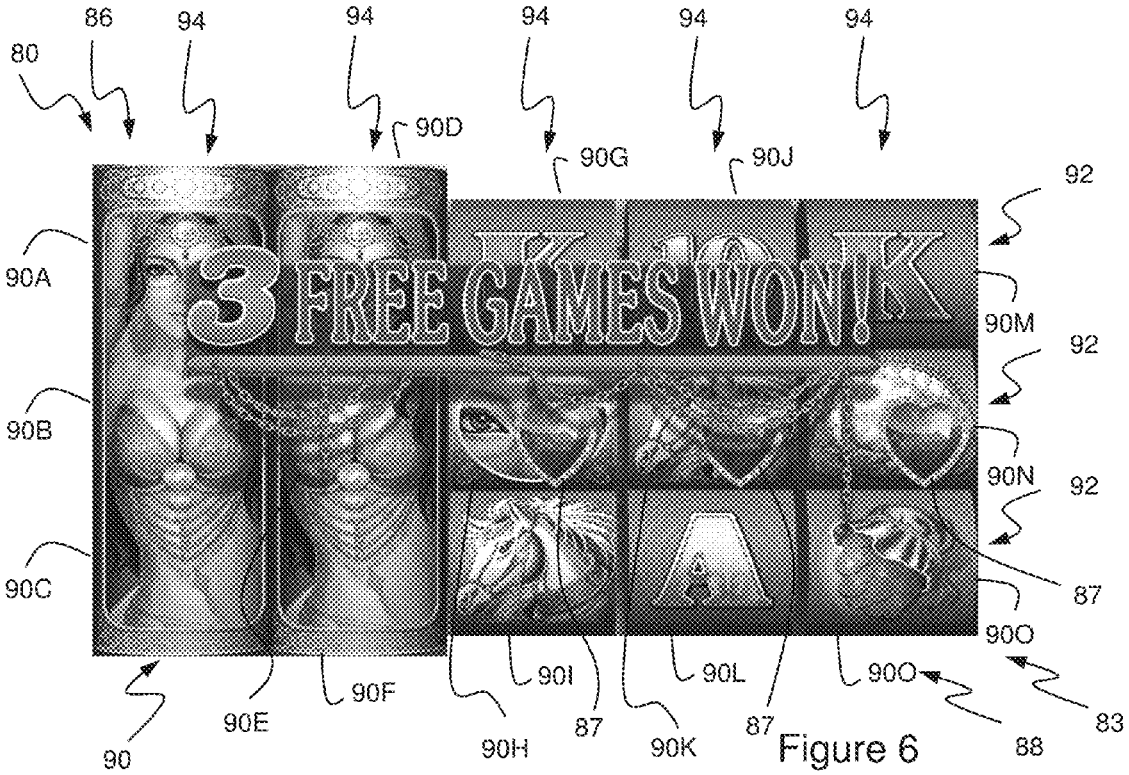
FIG. 6 is a second graphical representation of a portion of the gaming machine shown in FIG. 1 including an exemplary video slot game illustrating a plurality of slot reels, according to an embodiment of the present invention.

With reference to FIGS. 6 and 8, a second scatter symbol 87 may be used during the bonus game. As in the main game, the appearance of a predetermined number, e.g., 3, of scatter symbols 87 in the initial outcome of the bonus game (or free spin), may trigger the award of additional free spins (see FIG. 6). Additionally, as can be seen in FIG. 6, a stack of symbols may appear in the first two columns 94. FIG. 6 shows an exemplary secondary outcome in which the symbols 86 in the first two columns 94 have been upgraded +3 based on the number of scatter symbols.

Figure 7:
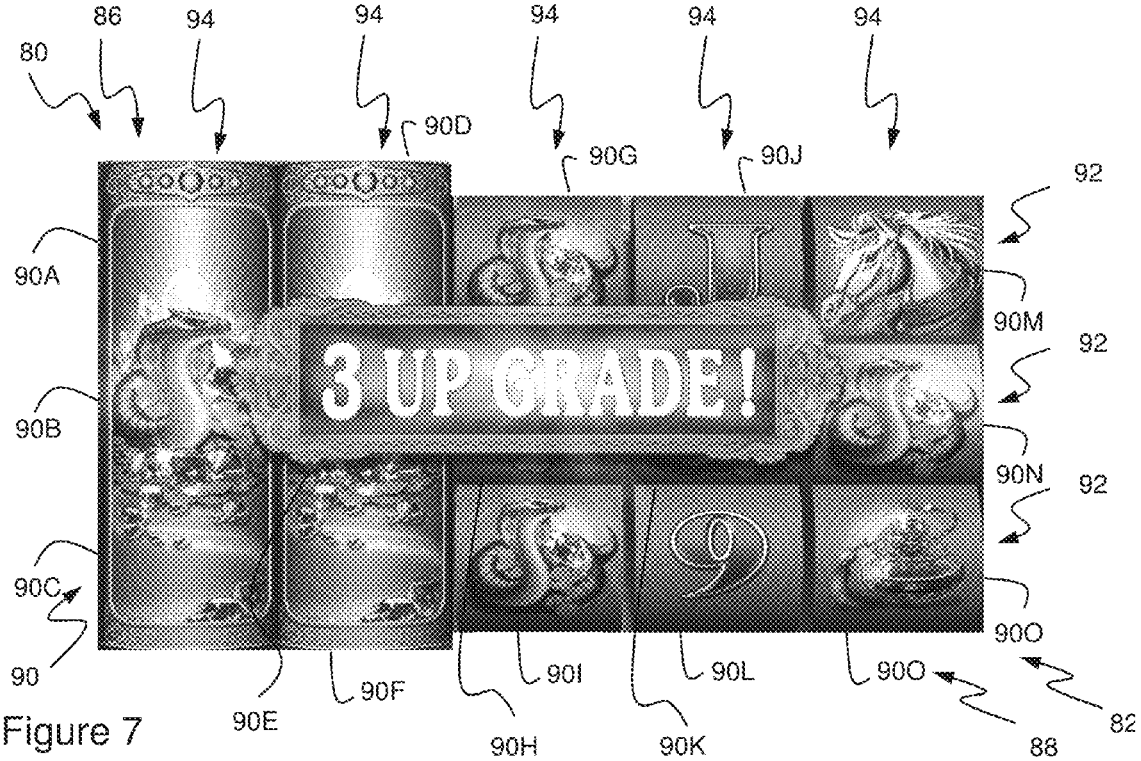
FIG. 7 is a third graphical representation of a portion of the gaming machine shown in FIG. 1 including an exemplary video slot game illustrating a plurality of slot reels, according to an embodiment of the present invention.

With reference to FIG. 7, an exemplary initial outcome 82 of a bonus game or free spin. In this example, the large symbols (the cobra symbol) will be upgraded by +3 to the princess symbol.

Alternative Embodiment

Figure 11:
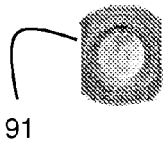
FIG. 11 is a graphical representation of a first predetermined symbol, according to another embodiment of the present invention; and, FIG. 12 is a graphical representation of a second predetermined symbol, according to another embodiment of the present invention.
Figure 12:
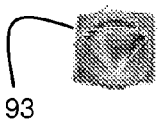

In an alternative embodiment, the upgrade feature may be triggered during a re-spin feature. For example, in one embodiment, one of the symbols in the set of game symbols may be designated as a re-spin trigger symbol 91 (see FIG. 11). If during a play of a video slot game, the one or more re-spin trigger symbols 91 appear in the outcome of the game, the player is awarded a number of re-spins. The number of re-spins may be equal to the number of re-spin trigger symbols 91 that appear in the outcome of the game. During the re-spin feature, the re-spin trigger symbol 91 is transformed into one of the other game symbols in the set of game symbols.

In one embodiment, the reels which contained the transformed re-spin trigger symbols 91 are held. Additionally, reels containing one or more others of the game symbols may also be held. All other reels are re-spun.

In one aspect of the present invention, the upgrade feature may be triggered during the re-spin feature. In one embodiment, the triggering condition for the upgrade feature is the appearance of a predetermined number of a predetermined one of the game symbols in the set of game symbols. In another aspect of the present invention, the number of upgrades is equal to the number of re-spins remaining. For example, if the triggering condition occurs during a re-spin and there are 2 re-spins remaining, then the number of upgrades is equal to the number of re-spins remaining.

Exemplary embodiments of a gaming machine and a method of allowing a player to play a gaming machine are described above in detail. The gaming machine, system, and method are not limited to the specific embodiments described herein, but rather, components of the gaming machine and/or system and/or steps of the method may be utilized independently and separately from other components and/or steps described herein. For example, the gaming machine may also be used in combination with other gaming systems and methods, and is not limited to practice with only the gaming machine as described herein. Rather, an exemplary embodiment can be implemented and utilized in connection with many other gaming system applications.

A controller, computing device, or computer, such as described herein, includes at least one or more processors or processing units and a system memory. The controller typically also includes at least some form of computer readable media. By way of example and not limitation, computer readable media may include computer storage media and communication media. Computer storage media may include volatile and nonvolatile, removable and non-removable media implemented in any method or technology that enables storage of information, such as computer readable instructions, data structures, program modules, or other data. Communication media typically embody computer readable instructions, data structures, program modules, or other data in a modulated data signal such as a carrier wave or other transport mechanism and include any information delivery media. Those skilled in the art should be familiar with the modulated data signal, which has one or more of its characteristics set or changed in such a manner as to encode information in the signal. Combinations of any of the above are also included within the scope of computer readable media.

The order of execution or performance of the operations in the embodiments of the invention illustrated and described herein is not essential, unless otherwise specified. That is, the operations described herein may be performed in any order, unless otherwise specified, and embodiments of the invention may include additional or fewer operations than those disclosed herein. For example, it is contemplated that executing or performing a particular operation before, contemporaneously with, or after another operation is within the scope of aspects of the invention.

In some embodiments, a processor, as described herein, includes any programmable system including systems and microcontrollers, reduced instruction set circuits (RISC), application specific integrated circuits (ASIC), programmable logic circuits (PLC), and any other circuit or processor capable of executing the functions described herein. The above examples are exemplary only, and thus are not intended to limit in any way the definition and/or meaning of the term processor.

In some embodiments, a database, as described herein, includes any collection of data including hierarchical databases, relational databases, flat file databases, object-relational databases, object oriented databases, and any other structured collection of records or data that is stored in a computer system. The above examples are exemplary only, and thus are not intended to limit in any way the definition and/or meaning of the term database. Examples of databases include, but are not limited to only including, Oracle® Database, MySQL, IBM® DB2, Microsoft® SQL Server, Sybase®, and PostgreSQL. However, any database may be used that enables the systems and methods described herein. (Oracle is a registered trademark of Oracle Corporation, Redwood Shores, Calif.; IBM is a registered trademark of International Business Machines Corporation, Armonk, N.Y.; Microsoft is a registered trademark of Microsoft Corporation, Redmond, Wash.; and Sybase is a registered trademark of Sybase, Dublin, Calif.)

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Other aspects and features of the present invention can be obtained from a study of the drawings, the disclosure, and the appended claims. The invention may be practiced otherwise than as specifically described within the scope of the appended claims. It should also be noted, that the steps and/or functions listed within the appended claims, notwithstanding the order of which steps and/or functions are listed therein, are not limited to any specific order of operation.

Although specific features of various embodiments of the invention may be shown in some drawings and not in others, this is for convenience only. In accordance with the principles of the invention, any feature of a drawing may be referenced and/or claimed in combination with any feature of any other drawing.

What is claimed is:

1. A slot machine configured to display a game and provide an award to a player via the slot machine to facilitate increasing player interest and increasing profitability of the slot machine, comprising:

a database including at least one paytable and a set of game symbols associated with the game, the game symbols in the set of game symbols being arranged in a predetermined order from a lowest value to a highest value;

a display device configured to display a plurality of symbol regions being arranged in a grid, the display device being further configured to display the game symbols on a plurality of reels associated with the symbol regions and to display one of the plurality of game symbols in each of the symbol regions; and, a controller coupled to the database and the display device and being configured to:

randomly select an initial outcome of the game including generating a random number and selecting a combination of the game symbols from the database as a function of the random number, display the initial outcome including the combination of game symbols on the display device, and provide an initial award to the player as a function of the initial outcome and the at least one paytable, the initial outcome of the game including an initial game symbol associated with each of the symbol regions;

detect a triggering condition associated with the symbols displayed with the initial outcome of the game and to responsively identify the initial game symbol being displayed in at least one predetermined symbol region;

determine a ranking of the initial game symbol within the predetermined order of game symbols included in the database;

determine an offset from the initial game symbol within the predetermined order of game symbols; and replace the initial game symbol with a replacement symbol to establish a secondary outcome of the game and display the secondary outcome on the display device, the replacement symbol being determined as a function of the ranking of the initial game symbol within the predetermined order of the game symbols and the determined offset from the initial game symbol ranking.

2. The slot machine of claim 1, the controller allowing the player to make a wager and awarding the player an initial award as a function of the wager, the initial outcome and an initial paytable.

3. The slot machine of claim 2, the controller awarding a secondary award as a function of the secondary outcome and a secondary paytable.

4. The slot machine of claim 3, wherein the initial paytable and the secondary paytable are different.

5. The slot machine of claim 2, the controller awarding the player an award as a function of the wager, the secondary outcome and a paytable.

6. The slot machine of claim 1, the controller displaying the initial outcome and the secondary outcome in the grid.

7. The slot machine of claim 1, wherein the grid has a plurality of columns, each column having at least two symbol positions.

8. The slot machine of claim 7, wherein the at least two symbol positions of at least one of the columns form a single reel.

9. The slot machine of claim 8, wherein each of the at least two symbol positions of at least one other of the columns form an individual reel.

10. The slot machine of claim 9, the at least two symbol regions of any single reel are predetermined symbol regions in which the initial symbols are replaced with replacement symbols if the triggering symbol is detected.

11. The slot machine of claim 10, wherein each replacement symbol is determined as a function of a set offset from the associated initial symbol in the predetermined order.

12. The slot machine of claim 11, wherein the each replacement symbol is higher in order than the initial symbol along the predetermined order.

13. The slot machine of claim 1, wherein the triggering condition is the appearance of a predetermined symbol.

14. The slot machine of claim 13, wherein the predetermined symbol is one of the symbols in the set of game symbols and the triggering condition is the appearance of the predetermined symbol in the initial outcome of the game.

15. The slot machine of claim 13, wherein the predetermined symbol is a scatter symbol.

16. The slot machine of claim 13, wherein the each replacement symbol is determined as a function of an offset from the associated initial symbol in the predetermined order.

17. The slot machine of claim 16, wherein the offset is equal to the number of predetermined symbols.

18. The slot machine of claim 16, wherein the triggering condition occurs to a re-spin feature and the offset is equal to a number of re-spins remaining.

19. A method of displaying a game and providing an award to a player via a slot machine to facilitate increasing player interest and increasing profitability of the slot machine, the slot machine having a display device, a database, and a controller, the database including at least one paytable and a set of game symbols associated with the game, the game symbols in the set of game symbols being arranged in a predetermined order from a lowest value to a highest value, the method including the steps of:

the controller displaying on the display device a plurality of symbol regions, the symbol regions being arranged in a grid;

the controller randomly selecting an initial outcome of the game including generating a random number and selecting a combination of the game symbols from the database as a function of the random number;

the controller displaying the initial outcome on the display device including displaying the combination of game symbols on a plurality of reels associated with the symbol regions, and providing an initial award to the player as a function of the initial outcome and the at least one paytable, the initial outcome of the game including an initial game symbol associated with each of the symbol regions; and, the controller detecting a triggering condition associated with the initial outcome of the game and responsively identifying the initial game symbol being displayed in at least one predetermined symbol region, determining a ranking of the initial game symbol within the predetermined order of game symbols included in the database, determining an offset from the initial game symbol within the predetermined order of game symbols, and replacing the initial game symbol with a replacement symbol to establish a secondary outcome of the game and display the secondary outcome on the display device, the replacement symbol being determined as a function of the ranking of the initial symbol within the predetermined order of the game symbols and the determined offset from the initial game symbol ranking.

20. A method, as set forth in claim 19, including the steps of allowing the player to make a wager and awarding the player an initial award as a function of the wager, the initial outcome and an initial paytable.

21. A method, as set forth in claim 20, including the step of awarding a secondary award as a function of the secondary outcome and a secondary paytable.

22. A method, as set forth in claim 21, wherein the initial paytable and the secondary paytable are different.

23. A method, as set forth in claim 19, including the step of awarding the player an award as a function of the wager, the secondary outcome and a paytable.

24. A method, as set forth in claim 19, including the step of displaying the initial outcome and the secondary outcome in the grid.

25. A method, as set forth in claim 19, wherein the grid has a plurality of columns, each column having at least two symbol positions.

26. A method, as set forth in claim 25, wherein the at least two symbol positions of at least one of the columns form a single reel.

27. A method, as set forth in claim 26, wherein each of the at least two symbol positions of at least one other of the columns form an individual reel.

28. A method, as set forth in claim 27, wherein the at least two symbol regions of any single reel are predetermined symbol regions in which the initial symbols are replaced with replacement symbols if the triggering symbol is detected.

29. A method, as set forth in claim 28, wherein each replacement symbol is determined as a function of a set offset from the associated initial symbol in the predetermined order.

30. A method, as set forth in claim 29, wherein the each replacement symbol is higher in order than the initial symbol along the predetermined order.

31. A method, as set forth in claim 19, wherein the triggering condition is the appearance of a predetermined symbol.

32. A method, as set forth in claim 31, wherein the predetermined symbol is one of the symbols in the set of game symbols and the triggering condition is the appearance of the predetermined symbol in the initial outcome of the game.

33. A method, as set forth in claim 31, wherein the predetermined symbol is a scatter symbol.

34. A method, as set forth in claim 31, wherein the each replacement symbol is determined as a function of an offset from the associated initial symbol in the predetermined order.

35. A method, as set forth in claim 34, wherein the offset is equal to the number of predetermined symbols.

36. A slot machine, as set forth in claim 35, wherein the triggering condition occurs to a re-spin feature and the offset is equal to a number of re-spins remaining.

37. A non-transitory information recording medium on which a computer readable program is recorded that causes a computer to function as a slot machine being configured to display a game and provide an award to a player via the slot machine to facilitate increasing player interest and increasing profitability of the slot machine, the program causing the computer to function as a:

a controller coupled to a database and a display device, the database including a paytable and a set of game symbols associated with the game, the game symbols in the set of game symbols being arranged in a predetermined order from a lowest value to a highest value, the display device configured to display a plurality of symbol regions, the symbol regions being arranged in a grid, the display device being further configured to display the game symbols on a plurality of reels associated with the symbol regions and to display one of the plurality of game symbols in each of the symbol regions, the controller being configured to randomly select an initial outcome of the game including generating a random number and selecting a combination of the game symbols from the database as a function of the random number, display the initial outcome including the combination of game symbols on the display device, and provide an initial award to the player as a function of the initial outcome and the paytable, the initial outcome of the game including an initial game symbol associated with each of the symbol regions, the controller being further configured to detect a triggering condition associated with the initial outcome of the game and to responsively identify the initial game symbol being displayed in at least one predetermined symbol region, determine a ranking of the initial game symbol within the predetermined order of game symbols included in the database, determine an offset from the initial game symbol within the predetermined order of game symbols, and replace the initial game symbol with a replacement symbol to establish a secondary outcome of the game and display the secondary outcome on the display device, the replacement symbol being determined as a function of the ranking of the initial game symbol within the predetermined order of the game symbols and the determined offset from the initial game symbol ranking.

* * * * *